US005417388A

United States Patent [19]

Stillwell

[11] Patent Number: 5,417,388

[45] Date of Patent: May 23, 1995

[54] TRAIN DETECTION CIRCUIT

[76] Inventor: William R. Stillwell, 207 W. Broadway, West Harrison, Ind. 47060

[21] Appl. No.: 92,128

[22] Filed: Jul. 15, 1993

[51] Int. Cl.[6] ..... B61L 13/00

[52] U.S. Cl. ..... 246/122 R; 246/122 A; 246/249; 246/255

[58] Field of Search ..... 246/122 R, 123, 124, 246/122 A, 249, 34 R, 247, 34 B, 36, 37, 40, 58, 28 F, 28 D, 255

[56] References Cited

U.S. PATENT DOCUMENTS

| | | | |
|---|---|---|---|
| 1,153,922 | 9/1915 | Hummel . | |
| 3,594,572 | 7/1971 | Horeczky . | |
| 3,610,920 | 10/1971 | Frielinghaus | 246/122 R |
| 3,821,544 | 6/1974 | Matty | 246/122 R |
| 4,320,881 | 3/1982 | Campbell . | |
| 4,351,504 | 9/1982 | Frielinghaus | 246/122 R |
| 4,373,691 | 2/1983 | Fricke et al. | 246/122 R |
| 4,432,517 | 2/1984 | Ripamonti . | |
| 4,469,298 | 9/1984 | Uebel | 246/122 R |
| 4,487,385 | 12/1984 | Salmon | 246/122 R |
| 4,535,959 | 8/1985 | Gilcher | 246/122 R |
| 4,582,279 | 4/1986 | Pontier . | |
| 4,723,737 | 2/1988 | Mimoun . | |

FOREIGN PATENT DOCUMENTS

| | | | |
|---|---|---|---|
| 0930644 | 3/1963 | United Kingdom | 246/122 R |
| 0933655 | 8/1963 | United Kingdom | 246/122 R |

*Primary Examiner*—Mark T. Le
*Attorney, Agent, or Firm*—Frost & Jacobs

[57] ABSTRACT

A train detection circuit is provided to determine whether a particular section or block of railroad track is occupied by a train. In one embodiment, a bias current generator is used to provide a low current signal that flows through the rails and through the wheels and axles of a railroad engine or car, such bias current ultimately being directed into a train detection circuit which measures the magnitude of the received bias current. If the bias current is greater than a certain magnitude, that is indicative of the particular block being occupied by a train. In second embodiment, a continuous pulse signal is directed into one rail, through a resistance bond, and through the other rail into a train detection circuit. The magnitude of this received pulse at the detection circuit will be quite small unless a train occupies the block. The received magnitude of the pulse signal can be compared to a predetermined threshold to determine the presence of a train in the block. The use of such pulse signals can also be used to determine from which direction a train enters this particular block, and can be provided with a high-pass filter to receive a clear high frequency pulse signal even in the presence of lower frequency signals.

15 Claims, 4 Drawing Sheets

TRAIN DETECTION CIRCUIT

TECHNICAL FIELD

The present invention relates generally to the automatic detection of railroad trains on railroad tracks, and is particularly directed to a train detection circuit of the type which can additionally determine from which direction the train entered a particular section of railroad track. The invention is specifically disclosed as a bias current detection circuit to detect model railroad engines that are not moving, and as a pulse delay detection circuit to detect the direction of movement of both full scale and model railroad trains.

BACKGROUND OF THE INVENTION

Electrical circuits to detect the presence or absence of trains on railroad tracks is well known in the art, such train detecting circuits being used to control the railroad traffic control devices such as signal lights. For full-scale railroads, existing track detection circuits generally comprise a voltage or current source which is electrically connected to both rails at one end of a section (known as a "block") of track. On the opposite end of the block, both rails are electrically connected to some type of receiver or detection device. An electrical power source, typically a battery, connected to the first end of the block provides a current that flows in opposite directions through the parallel rails if no train occupies the block, and so long as the rails have maintained electrical continuity.

When no train occupies this block, the currents applied to the first rail travels from the first end (the power source end) of the block along the first rail to the second end of the block, through a relay coil, and to the second rail. The current then returns on the second rail from the second end of the block to the first end of the block. In this way, the relay coil at the far end of the block is normally energized, thereby making the operation of this system failsafe, so that if a rail should break, there would be no current flow and the relay coil would become de-energized. In typical railroad applications, the supply voltage is in the range of 1–3 volts DC, and the current that flows through the rails when no train is present should be at least 72 milliamperes to energize the relay coil at the far (second) end of the block.

If a train occupies this block, the current supplied by the battery is shunted from the first rail to the second rail by the wheels and axles of the train. When this occurs, there will be essentially no current flowing through the relay coil at the far end of the block, and it becomes de-energized. The contacts of that relay are then used to indicate to the railroad dispatcher that the block is occupied by a train. This information alone does not, however, indicate which direction a train is moving within the block.

To determine the direction of a train as it enters a block, all railroads employ a half-block boundary method which requires additional electrical circuitry and a separate electrical power source and relay for each half of the block. Depending upon which relay is energized for a given half-block, the direction of the train can be determined. The signals from each half-block relay can be transmitted to a third relay which is indicative of whether a train occupies any part of that particular block.

Train detection circuits for model railroads have been available which sense the current supplied by the electrical power supply that provides current to the electric motor of the model railroad engine. The current supplied to turn the motor of the model railroad engine is detected, thereby providing an indication that a model railroad engine is within a particular section or "block" of track. In the case of alternating current model railroads, the train detection circuit simply determines whether or not any current is flowing through that particular block.

In the case of direct current model railroads, a train detecting circuit must be able to work with currents in either direction, since the model railroad engines can operate with either polarity through their motors. As with alternating current model railroads, a simple determination as to whether current exists or not, in either polarity, provides an indication that an electric train engine occupies that particular section of track.

Existing model railroad train detection circuits do not have the capability of determining from which direction a train is entering the block. In addition, existing model railroad train detection circuits provide no indication that a block is occupied when the electric engine is merely resting on that block (and is not moving) because no current is being supplied to its motor.

SUMMARY OF THE INVENTION

Accordingly, it is a primary object of the present invention to provide an electrical circuit that can determine the presence or absence of a train in a particular section or block of railroad track.

It is another object of the present invention to provide an electrical circuit that can determine the presence or absence of a non-moving train in a particular block when used with a model railroad.

It is a further object of the present invention to provide an electrical circuit that can determine the direction of travel of a train as it occupies a particular block.

It is yet another object of the present invention to provide an electrical circuit that can determine whether a broken rail exists within a particular block.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved train detection circuit is provided for detecting either model railroad engines or full-scale railroad traffic in a particular section or block of railroad track. In an embodiment used to detect the presence of full-scale trains, an electrical signal generator is used to output a pulse signal to one of the rails at one end of a particular block. If no rail traffic is occupying the block, this pulse signal will travel to the opposite end of the block, through a resistance bond that carries it to the second, parallel rail, and then back to the first end of the block. At this point, the pulse signal is directed into a pulse detection circuit which determines the magnitude of the received pulse signal, in which the magnitude of the pulse signal is indicative of the presence or absence of rail traffic upon this particular block of track.

If no rail traffic is present, then the magnitude of the pulse signal received by the pulse detection circuit should be very small as compared to the magnitude of the pulse signal as it leaves the signal generator. If, on the other hand, rail traffic is present in this block, the pulse signal travelling down the first rail will be shunted to the second rail through the wheels and axles of the rail traffic. Since the wheels and axles of a railroad engine or car have a very low resistance value, the magnitude of the pulse signal will be significantly increased at the input to the detection circuit.

In addition to determining the presence or absence of a train upon this section of track, the detection circuit can be modified to also determine the direction that the train is traveling along this particular block. As each pulse is output from the signal generator, the pulse will be received at the track detection circuit after a particular time interval has expired, the time interval occurring due to the propagation time required for the pulse signal to travel the required distance. If this block is unoccupied, the delay interval will be at a maximum value. As a train enters the block, the wheels and axles of the train will shunt the signal path of the pulse signal from the first rail to the second rail, thereby decreasing the propagation time of the pulse as it travels from the signal generator to the track detection circuit. If the train enters this particular block at the same end that the signal generator and track detector circuit are located, then the propagation delay will be nearly zero, or at least at a certain minimum time interval. As the train moves further away from that end of the block, then the propagation time will begin to increase. This propagation delay can be measured to determine which direction the train is moving.

If, on the other hand, a train enters at the opposite end of the block, the initial propagation time of the pulsed signal will remain approximately equal to the time when there was no train present at all. However, the track detection circuit will detect the presence of the train in this block, and this information, when combined with the amount of propagation delay, is used to determine which direction the train is moving. In this instance, the propagation delays will begin to decrease as the train moves closer to the end of the block having the signal generator and track detector.

In addition to determining the presence or absence of a train upon this section of track, the detection circuit with the propagation time sensing capability (discussed above) can be used to determine whether or not a rail is broken within the block. As each pulse is output from the signal generator, the pulse will be received at the track detection circuit after a particular time interval has expired, the time interval being equal to the propagation time required for the pulse signal to travel the required distance. If this block is unoccupied, the time interval will be a particular constant value, unless there is a break in the continuity of the electrical circuit, which would be likely due to a broken rail. The time required to propagate through the electrical circuit may be less than this particular constant value if a train occupies the block. However, the propagation time should never be greater than this particular constant value, unless the circuit is broken. Therefore, a time threshold somewhat greater than this particular constant value can be used to determine if the pulses are being properly returned to the detection circuit, thereby providing an indication of continuity of the electrical circuit.

In a second embodiment used to detect the presence of a model train in a particular section or block of track, an electrical power supply is used to supply a bias current to one of the rails in that block. The other parallel rail is connected to a bias current detector. If no train occupies the block, no current will flow from the first rail to the second rail, and the detector circuit will indicate that the block is unoccupied. In a typical electric model train, the engines use electric motors to propel the train around the track. A separate throttle power pack is typically used to supply the current and voltage necessary to turn the motor of such model train engines, and when that occurs, current will flow from the first rail to the second rail and through the train detection circuit. When this occurs, regardless of the polarity of the voltage signals being received at the train detector circuit, the detector circuit will indicate that this particular block is occupied.

If the model train is not moving, i.e., the throttle power pack is not supplying any current to the electric motor of the model train engine, then the bias current will flow from the first rail to the second rail through the same wheels and motor of the model railroad engine, and finally into the track detector circuit. The bias current is small enough in magnitude that the motor will not turn due to the bias current alone. Under this circumstance, the track detector circuit will again indicate that this particular block of track is occupied.

This second embodiment can also include a circuit which will detect the direction of the model train while it is travelling in a particular block. To detect the direction of a train, a signal generator is connected to one end of the block to a rail, typically the same rail which is connected to the bias current supply. This pulse signal travels down that rail to the opposite end of the block where a resistance bond carries the pulse signal to the opposite, parallel rail, at which time the pulse signal travels back toward the end having the signal generator, and then enters the track detector circuit. In this configuration, the track detector circuit must be able to discriminate between the amplitude of the pulse signals provided by the signal generator and the bias current supplied by the bias power supply.

The train detector circuit first determines whether or not a train occupies this particular block, and if not, it will indicate that the block is unoccupied and will provide a zero volt signal to a second output which is directed into a filter circuit. On the other hand, if a train is occupying this block, the train detector circuit will indicate that the block is occupied, amplify the received signal from the second rail, and direct that signal to the second output and into a high-pass filter circuit. The high-pass filter attenuates all low frequency signals, including the bias current from the bias power supply and the power pack throttle current and voltage, including voltages supplied by pulsed throttle power packs. The output of the high-pass filter, therefore, is a signal which emulates the original pulsed signal generated by the signal generator, except that it has been delayed by a certain propagation time. This delayed signal is analyzed in a similar fashion to the received pulse signal of the full-scale train detection circuit, described hereinabove.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
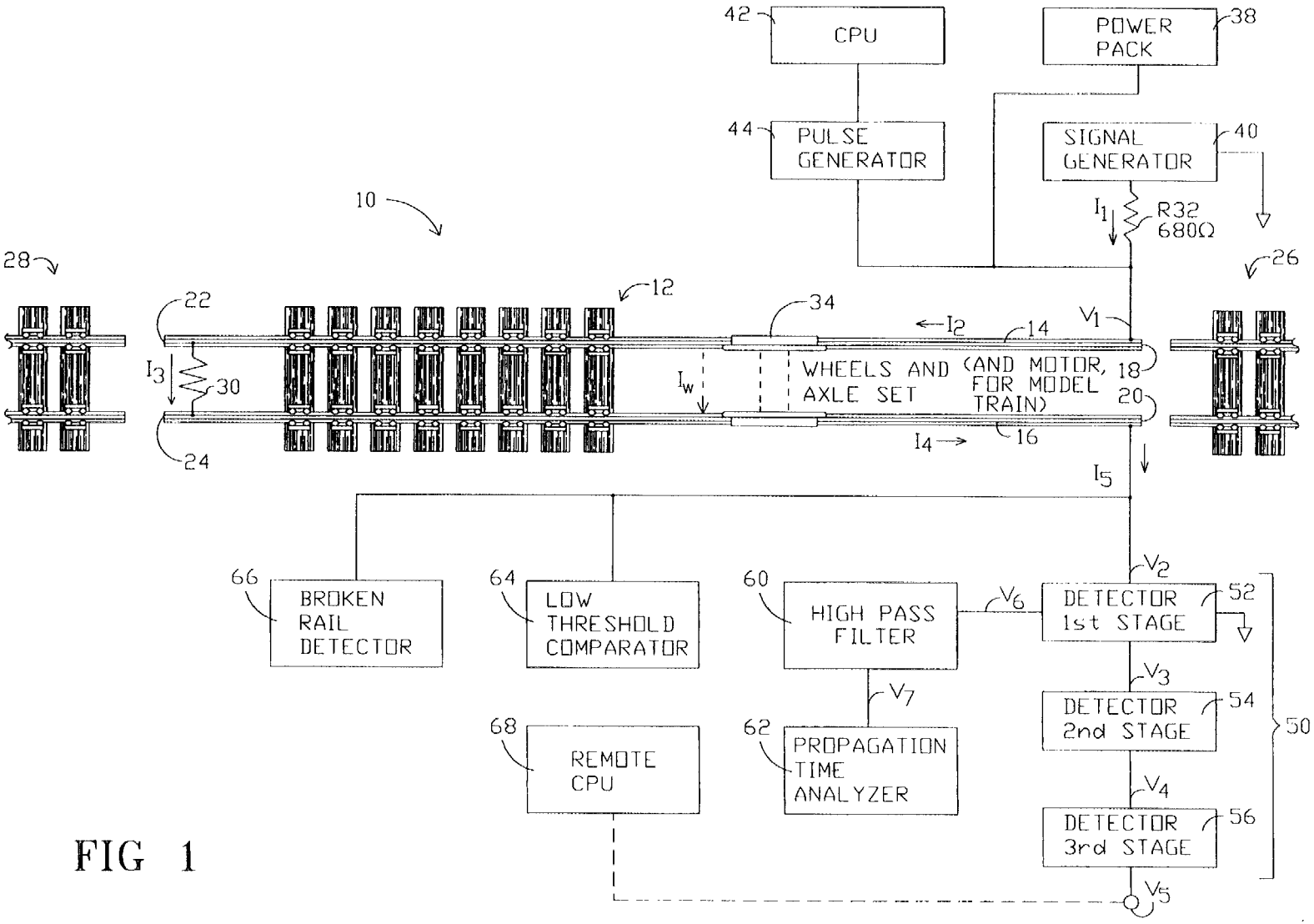
FIG. 1 is a diagrammatic view of a railroad track block and a train detection system constructed according to the principles of the present invention.

Referring now to the drawings, FIG. 1 shows a section or "block" of railroad track, depicted by the index numeral 12. A train detection system, generally designated by the index numeral 10, is provided to detect whether or not block 12 is occupied by railroad traffic. As used herein, the term "railroad traffic" means the engines and cars used on a railroad track, whether such engines and cars are the equivalent to an official "train" or not. Block 12 consists, in the illustrated embodiment, of a north rail 14 and a parallel south rail 16. North rail 14 has an east point 18 and west point 22. South rail 16 has an east point 20 and west point 24. Adjacent to the east points 18 and 20 is an adjoining east block 26 of railroad track, and adjacent to the west points 22 and 24 is an adjoining west block 28 of railroad track. It will be understood that rails 14 and 16 must be electrically insulated from the rails of adjoining blocks 26 and 28. It will be further understood that the geographic orientation of the railroad track of block 12 can be along any point of the compass, particularly with curves, and the above descriptions are typical for described railroad track layouts described in technical specifications.

A resistance bond 30 is connected from the west point 22 of the north rail 14 to west point 24 of the south rail 16. Resistance bond 30 is used in some circumstances to provide an electrical path for current flow from north rail 14 to south rail 16. The resistance value of resistance bond 30 depends upon the exact application that train detection system 10 is being used for, and will be discussed in detailed hereinbelow.

Train detection system 10 includes a signal generator 40, which outputs an electrical signal to the east point 18. The output signal of signal generator 40 can be a bias current, a continuous pulse train, or a repeated cycle of pulse bursts that can be turned on or off under the control of a computer 42. The type of output signal to be generated by signal generator 40 depends upon the exact application for which train detection system 10 will be used, and will be described in detail hereinbelow.

A train detection circuit, generally designated by the index numeral 50, is connected to the east point 20. The first stage 52 of train detection circuit 50 has an input that is directly connected to east point 20. The function of first stage 52 is to perform a comparison between the input signal $v_2$ and a predetermined threshold. First stage 52 outputs a signal $v_3$ into a second stage 54 of the detector 50, and second stage 54 has a timing circuit and outputs to indicate the direction of the movement of train under certain circumstances, described in detailed hereinbelow. Second stage 54 has an output $v_4$ that drives into a third stage 56 of the detector 50, which provides a visual indication of whether a train has been detected, and provides a higher voltage and current output signal $v_5$.

The first stage 52 of train detection circuit 50 also provides a second output signal $v_6$ to a high-pass filter 60. The output of high-pass filter 60 is a signal $v_7$ that is provided as an input to a propagation time analyzer 62. Propagation time analyzer 62 can be used to determine the direction of a train as it enters block 12.

Figure 2:
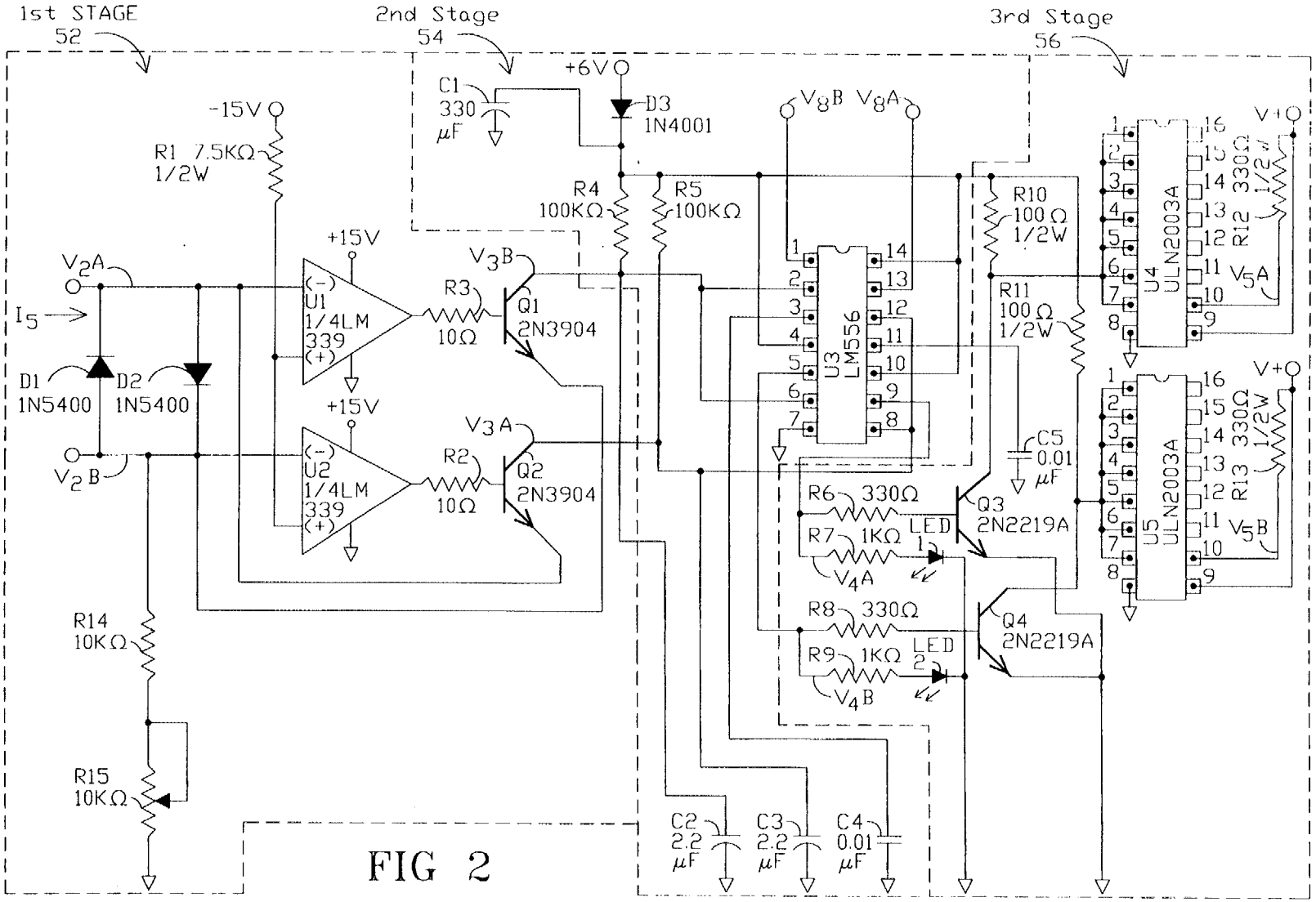
FIG. 2 is a schematic diagram of the train detection circuit used in the train detection system of FIG. 1.

FIG. 2 describes train detection circuit 50 in detail, and includes first stage 52, second stage 54, and third stage 56. If signal generator 40 outputs a signal $v_1$ (see FIG. 1), a current $I_1$ will flow from the signal generator 40 to east point 18, and if the electrical circuit is closed, a current $I_2$ will flow along north rail 14 to west point 22. If resistance bond 30 has a resistance other than infinity, a current $I_3$, will flow from north rail 12 to south rail 16, and a current $I_4$ will flow along south rail 16 from west point 24 to east point 20. At that point, a current $I_5$ will flow into the first stage 52 of train detection circuit 50. Current $I_5$ can be converted into a voltage $v_2$ and used in determining whether a train occupies block 12. Referring to FIG. 2, current signal $I_5$ flows either through diode D1 or D2, depending upon the polarity of current signal $I_5$. A voltage signal $v_2A$ or $v_2B$ will be generated due to current signal $I_5$, and these voltage signals are used to drive the input of voltage comparators U1 and U2. Diodes D1 and D2 are preferably of type 1N5400, and voltage comparators U1 and U2 are preferably model number LM339, manufactured by National Semiconductor Corporation.

For use with a model electric train, signal generator 40 will consist of a bias current source that generates a direct current $I_1$. Current $I_1$ is limited by a resistor 32, and in the illustrated embodiment, resistor 32 preferably has a value of 680Ω when voltage signal $v_1$ is a value of six volts DC (6 VDC) being output from signal generator 40. In the case for a model railroad where the direction of the train is not being determined by train detection system 10, resistance bond 30 would have a resistance value of infinity, i.e. there would be no resistor placed between north rail 12 and south rail 16. In this configuration, the only way current can flow between north rail 14 and south rail 16 is through the wheels, axles, and other type of electrical apparatus of the electric train itself. Typically this current would flow through the motor windings of an electric model train engine. Such current could also flow through a model train passenger car that had internal lighting that would complete an electrical circuit between north rail 14 and south rail 16.

If the model train engine is moving because its motor is using current provided from an electrical power pack 38, then in the case of a DC model railroad system, the polarity of the current flow through that motor will be in one direction if the train is moving to the east, and in the other direction if the train is moving to the west. The first stage 52 of train detection circuit 50 will operate in either polarity, by allowing current to flow through either diode D1 or D2, again depending upon the polarity of the current signal $I_5$. If $I_5$ is flowing in the direction shown on FIG. 2, then diode D2 would conduct and provide a positive voltage $v_2B$ into the positive input of voltage comparator U2. If the direction of current $I_5$ is in the opposite direction of that shown on FIG. 2, then diode D1 will conduct, thereby creating a positive voltage $v_2A$ at the positive input of voltage comparator U1.

In the case of an alternating current model electric train, where the electrical power pack 38 is providing current to the electric motor of a AC model train engine, diodes D1 and D2 will alternately conduct current (for half of each cycle of the sine wave), and will alternately create positive voltage signals $v_2A$ and $v_2B$ at the positive inputs of voltage comparators U1 and U2. Such alternating signals will continue so long as the AC model train engine occupies block 12.

If the power pack 38, used as the throttle control, is not providing any current at all (and the electric train is not moving) then the bias current provided by signal generator 40 will still flow through resistor 32 as current signal $I_1$, to the north rail 14 as current $I_2$, continuing through the wheels, axles and motor (designated here by the index numeral 34) of the model train engine as current $I_w$, and further continuing along south rail 16 as current signal $I_4$. This current signal will finally enter the first stage 52 as current signal $I_5$ in the direction shown on FIG. 2, thereby flowing through diode D2 and creating a positive voltage $v_2B$ at the input of voltage comparator U2. Bias current $I_1$ is not large enough in magnitude to actually turn the motor of an electric model train engine, however, it is large enough to be detected as a voltage signal $v_2A$ or $v_2B$ after flowing through diode D1 or D2. It will be understood that other methods of converting a current signal into a voltage could be used, such as the use of a inductor or an resistor. It will also be understood that means of comparing voltages or currents other than an LM339 voltage comparator integrated circuit chip could be used without departing from the principles of the present invention.

As can be seen from the foregoing description, train detection circuit 50 can be used to detect electric signals provided by model railroad power packs, whether they are AC or DC power packs, and additionally can detect the bias current provided by signal generator 40. The bias current $I_1$ is provided at all times by signal generator 40, however, it will be understood that bias current $I_1$ will be swamped by any output signal provided by a power pack. The effect, however, is still the same, in that the presence of an electric model railroad engine will be detected by train detection circuit 50 in either case.

The state of the outputs of voltage comparators U1 and U2 are indicative as to whether a sufficient current signal is being received at the input of the first stage 52 of train detection circuit 50. If the output of voltage comparator U2 is at its Logic 1 state, that indicates that signal $v_2B$ has a positive magnitude other than zero (or near zero), and that a train has been detected within block 12. This will occur whether that train is moving in one direction or is not moving at all, and in the latter case, the current signal $I_5$ is provided by signal generator 40 (as bias current $I_1$) rather than by a model railroad power pack 38.

On the other hand, if the output of voltage comparator U1 is in its Logic 1 state, that indicates that signal $v_2A$ is at a positive voltage magnitude other than zero (or near zero), and that a model train is running in the opposite direction compared to the situation where the output of voltage comparator U2 is in its Logic 1 state. Generally speaking, if a DC power pack is being used, U1 will be at a Logic 0 state if U2 is at a Logic 1 state, and vice versa when a model electric train engine occupies block 12. If an AC power pack is being used, and a model electric train engine occupies block 12, then both signals $v_2A$ and $v_2B$ would have non-zero positive values during alternating intervals, and the outputs of voltage comparators U1 and U2 would opposingly alternate between Logic 0 and Logic 1 states.

As indicated on FIG. 2, signal $v_2A$ is input into the positive input of voltage comparator U1, and signal $v_2B$ is input into the positive input of voltage comparator U2. The negative inputs of voltage comparators U1 and U2 are connected to a negative voltage provided by a −15 VDC power supply through a resistor R1, preferably having a value of 7.5 KΩ. In this configuration, the outputs of U1 and U2 will remain at Logic 0 if the input signals $v_2A$ and $v_2B$ remain at a voltage magnitude below the threshold voltage at the negative inputs of U1 and U2. If either signal $v_2A$ or $v_2B$ rise above that threshold voltage, then one of the outputs of U1 and U2 will rise to its Logic 1 state.

When voltage comparator U1 is in its Logic 1 state, a current will flow through resistor R3, thereby driving the base of transistor Q1 so that Q1 becomes saturated and switches on. When that occurs, the collector voltage of Q1 will drop to a value of less than one-half volt (0.5 VDC), and designated as voltage signal $v_3A$. Q1 is preferably an NPN transistor, having a part number 2N3904. The collector of transistor Q1 is pulled up through a resistor R4 and a diode D3 to a +6 VDC power supply rail. This power supply rail has a filter capacitor C1 which is also connected to the common of the power supply.

In a similar manner, if the output state of voltage comparator U2 is at Logic 1, then current will flow through resistor R2 into the base of transistor Q2 (preferably a 2N3904) which will drive transistor Q2 to saturation, thereby lowering the collector voltage, signal $v_3B$, to a value of less than 0.5 VDC. The collector of transistor Q2 is pulled up through the combination of resistor R5 and diode D3 to a +6 VDC power supply rail.

Resistors R4 and R5 are the front end portion of the second stage 54 of train detection circuit 50. Voltage signals $v_3A$ and $v_3B$ are directed into inputs of a dual timer integrated circuit U3, which preferably a model LM556, manufactured by National Semiconductor Corporation. Second stage 54 uses dual timer U3 as a resettable on-delay timer, such that its outputs are driven to their opposite logic states upon the reception of a voltage transition at its inputs, and remain in the opposite logic states for a predetermined time period, according to timing capacitors C2 and C3, and timing resistors R4 and R5. Each time U3 receives a new voltage transition at its inputs, or if the input voltage remains in its transition state, the predetermined time period resets, so the outputs do not change state. Signal $v_3A$ is connected to pins 8 and 12 of timer U3, which drive the input of one of the timers of dual timer chip U3. Pin 8 is the Trigger, and pin 12 is the Threshold of that half of U3. Pin 10 is the Reset of this half of U3, and is connected to the positive voltage rail, along with the V+ pin 14. The Control Voltage, pin 11, is connected to the common of the power supply through a capacitor C5.

This half of dual timer U3 uses two different outputs, pin 13 (the Discharge output) and pin 9 (Vout). Discharge output (pin 13) generates a voltage signal $v_8A$, which is at a Logic 1 value if voltage signal $v_2A$ has sufficient positive magnitude to turn the output of voltage comparator U2 into its Logic 1 state. This would occur if a model railroad train is moving eastbound on track 12, which is the standard designation according to the industry standard originated by the National Model Railroaders' Association (NMRA). On the other hand, if voltage $v_2A$ is not of sufficient magnitude to drive voltage comparator U2 into its Logic 1 state, then voltage signal $v_3A$ will remain at a Logic 1 value, and the Discharge signal from pin 13 of U3 will remain at Logic 0.

Dual timer integrated circuit U3 provides output signals for a predetermined time interval regardless of the duration time of the input signals arriving at the first stage 52 of train detection circuit 50. Dual timer U3 is configured as a resettable timer, such that its output signal $v_8A$ will remain in a Logic 1 state so long as positive voltage pulses occur at voltage $v_2A$ within the time delay provided by timer U3, or if signal $v_2A$ is a positive magnitude DC signal. The Output signal, Vout, of this half of dual timer U3 (at pin 9) generates a voltage signal $v_4A$, which drives into the third stage 56 of train detection circuit 50.

If voltage $v_3B$ is near zero volts, meaning that transistor Q1 has been turned on, then the Discharge output, pin 1 of the other half of dual timer U3, will generate a Logic 1 voltage signal $v_8B$. Voltage signal $v_3B$ is connected as an input to the Threshold and Trigger inputs, pins 2 and 6 of this half of dual timer U3. Pin 4, the Reset input, is connected to the positive supply voltage rail, and the Control Voltage, pin 3, is connected to DC common through capacitor C4. A second Output is provided at pin 5 and directed, as voltage signal $v_4B$, into the third stage 56 of train detection circuit 50.

As related above, when a model train is moving eastbound on track 12, voltage $v_8A$ will be at a Logic 1 state and $v_4A$ will be at a Logic 0 state. Voltage signal $v_4A$ drives into a resistor R6, which provides current into the base of a transistor Q3, which preferably is a part number 2N2219A. Voltage signal $v_4A$ also drives into a resistor R7, which further carries a signal into LED1, which provides a visual indication that a train is moving eastbound on block 12. Any similar manner, if a train is moving westbound on block 12, the Logic states of voltage signals $v_8A$ and $v_4A$ will be the opposite of that just described, and voltage signal $v_8B$ will be at a Logic 1 state and voltage signal $v_4B$ will be a Logic 0 state. Voltage signal $v_4B$ drives into a resistor R8, which provides a base current into a transistor Q4, also preferably a model number 2N2219A. Voltage signal $v_4B$ also drives into a resistor R9 which further provides current for LED2, thereby providing a visual indication that a train is moving westbound in block 12. Transistor Q3 has its collector pulled up by resistor R10 which is connected to the positive voltage rail, and transistor Q4 has its collector pulled up by resistor R11, which is also connected to the same positive voltage rail.

During an eastbound train movement, voltage signal $v_4A$ is at Logic 0, transistor Q3 is turned off, and its collector is pulled up to near the supply voltage of +6 VDC. This collector signal is directed into the inputs of a Darlington transistor array U4, which preferably is a model number ULN2003A. Each of the outputs of U4 is an open collector Darlington transistor, and when its input voltage is at Logic 1 (as in the case of eastbound train in this example), its output transistor will be turned on and saturated so that its output voltage $v_5A$ is near zero volts. One typical output at pin 10 is illustrated having a pull-up resistor R12. As can be seen on FIG. 2, resistor R12 is connected a supply voltage of +15 VDC. The voltage output from pin 10, designated voltage signal $v_8A$, will allow a current to flow through R12 when the output is turned on to near zero volts. If a train is not moving eastbound on block 12, then transistor Q3 will be turned on, and its collective voltage will be near zero volts, thereby turning off each of the individual Darlington transistors in array U4. In this circumstance, voltage $v_5A$ at pin 10 will be raised to near the positive supply voltage rail (i.e. near +15 VDC), and very little current will flow through R12.

If a train is moving westbound through block 12, voltage signal $v_4B$ will be a Logic 0, thereby leaving transistor Q4 turned off, so that it collective voltage will be pulled up to near the +6 VDC supply rail. In this situation, all of the inputs to Darlington transistor array U5 will be at Logic 1 state, thereby turning on each of the individual Darlington transistors in array U5. One typical output, pin 10 of U5, generates a voltage signal $v_5B$ through a pull-up resistor R13, which is also connected to +15 VDC supply voltage. During the westbound train movement through block 12, $v_5B$ will be near zero volts, thereby allowing current to flow through resistor R13 from the +15 VDC supply rail. If there is no westbound movement occurring, then transistor Q4 will be turned on, and its collector will be saturated to near zero volts, thereby providing a Logic 0 state to the inputs of transistor array U5. In this circumstance, all of the outputs of array U5 will be in their Logic 1 states (i.e., near +15 VDC), and little or no current will flow through resistor R13.

It will be understood that output voltage signals $v_5A$ and $v_5B$ are opposite logic states of the same signal that is output by the third stage 56 of train detection circuit 50, and these signals are represented as a single signal $v_5$ on FIG. 1. This output signal $v_5$ can be communicated to a remote computer, such as CPU 68, to monitor railroad traffic.

A relatively recent development in model railroads is a method of controlling train movements known as "Command Control" With Command Control, each train operator has a radio transmitter which sends signals to an individual receiver in the cab of a model railroad engine. Electrical power is connected to the rails so that sufficient current will be available to provide the motive power for the electric motors inside each of the model train engines. In a Command Control configuration, the polarity of the current of the rails always remain the same even in situations where a train is moving either eastbound or westbound. This is accomplished through the use of a relay inside the receiver unit of each Command Control railroad engine. In this circumstance, the train detection circuit 50 described heresofar will not be able to sense the direction of movement of a Command Control engine, however, train detection circuit 50 will still be able to detect whether or not block 12 is occupied by a model railroad engine. To detect the train direction in a Command Control arrangement, an additional signal must be generated by a pulse generator 44, and the train detection circuit 50 must have additional electronic circuitry for the purposes of detecting the direction of the rail traffic. Such a detection circuit will be described in detail hereinbelow.

Train detection system 10 can also be used to detect the occupancy of block 12 for full scale railroads. Full scale railroads currently use an electrical power source, typically a battery, connected to one end of each of two half-blocks within block 12, to energize a relay coil in each half-block. Train detection system 10 provides a pulse generator 44 to output a voltage square wave as voltage signal $v_1$, and injected as a current $I_1$ to the east point 18 of the north rail 14. In this configuration, signal generator 40 and resistor 32 are not required. It is preferred that the voltage pulses be of relatively low magnitude, such as six volts VDC (6 VDC). It will be understood that square waves are the preferred waveforms for use with train detection circuit 10, however, other types of waveforms could be used, such as triangular waves, or sine waves.

Current $I_1$ will flow through north rail 14 as current $I_2$ over to the west point 22, then as current $I_3$, through resistance bond 30, which preferably have a resistance value of 1.0 MΩ. Current $I_3$ flows, through resistance bond 30, to the west point 24 of south rail 16, continues through south rail as current $I_4$ to the east point 20, then continues as current signal $I_5$ into train detection circuit 50. At this point, current signal $I_5$ will travel through diode D2, producing a voltage signal $v_2B$ at the positive input of voltage comparator U2. It will be understood that a bias current, such as used in the model railroad train detection circuit described hereinabove, could be used in a full scale railroad detection circuit. However, it is preferred that a square wave pulse be used as the output from pulse generator 44.

As the square waves are received at the positive input of voltage comparative U2, the magnitude of those square waves is compared to a threshold voltage provided at the negative input of U2, which is determined by resistor R1 and voltage supply of −15 VDC. If no train occupies block 12, the magnitude of voltage signal $v_2A$ will not be sufficient to change the state of the output of voltage comparator U2. This is because resistance bond 30 has such a large resistance that most of the voltage provided by pulse generator 44 will be absorbed or dissipated across resistance bond 30. By the time the current $I_5$ reaches the first stage 52 of train detection circuit 50, voltage signal $v_2A$ will be quite small, and the output state of voltage comparator U2 will remain at Logic 0.

If the operation of train detection system 10 is to be made failsafe, it is preferred that a second comparator 64 having a low threshold be added in parallel to the input of the first stage 52. Low threshold comparator 64 preferably comprises a voltage comparator chip such as an LM339 integrated circuit (not shown), having a substantially lower threshold so that it can detect the presence of the output of pulse generator 44, under all conditions except for the circumstance of a broken rail. As described above, resistance bond 30 will dissipate most of the voltage provided by voltage signal $v_1$, however, there will still be a low magnitude voltage pulse signal $v_2$ arriving at first stage 52 and low threshold comparator 64. The threshold setting at the negative input of the voltage comparator chip would be set low enough in magnitude so that even signal $v_2$'s small magnitude is sufficient to drive the chip to its Logic 1 output state, however, it is preferred that this lower threshold remains above the noise region.

If one of the rails 14 or 16 would happen to break, thereby disrupting the electrical continuity of train detection system 10, then no current at all would flow through the combination of rails and enter the detection circuit as current signal $I_5$. In such a circumstance, input voltage $v_2$ would essentially be zero volts and low threshold comparator 64 would detect that situation by its output falling to a Logic 0 state, and thereby provide an alarm signal to the train dispatcher.

When a train enters block 12, the wheels and axles (designated here by index numeral 34) of the train will shunt the current $I_3$ from north rail 14 to south rail 16, because these wheels and axles have a very low resistance. A typical resistance for a full scale railroad train wheels and axle set is 0.06Ω maximum, which is an industry standard set by the American Association of Railroads (AAR). Since most of the current between rails 14 and 16 now flows as $I_w$, as shown on FIG. 1, the voltage signal $v_2$ will be approximately equal in magnitude to voltage signal $v_1$ which is output from pulse generator 44. In this circumstance, the magnitude of $v_2A$ will be sufficient to change the output state of voltage comparator U2 from Logic 0 to Logic 1. If the voltage signals are square waves, as per the illustrated embodiment, then the output state of voltage comparator U2 will cycle between Logic 1 and Logic 0 at the pulse generator 44 output frequency of 50 MHz. It will be understood that frequencies other than 50 MHz could be used in train detection system 10 without departing from the teachings of the present invention.

As the output state of voltage comparator U2 rises to Logic 1, it turns on transistor Q2 which forces voltage signal $v_3A$ to clamp near zero volts. This actuates half of the dual timer integrated circuit U3 so that its Discharge output (pin 13) rises to a Logic 1, which is voltage signal $v_8A$. This will occur regardless of the direction of the train upon block 12. At the same time, the Output signal Vout (pin 9 of U3), which is voltage signal $v_4A$, will drop to Logic 0 and turn off transistor Q3. The collector of transistor Q3 will rise to near supply voltage, thereby turning on all of the Darlington transistors in Darlington transistor array U4. When that occurs, current can flow through any of the loads, such as resistor R12, that are connected to the outputs of array U4.

Even though the output state of voltage comparator U2 periodically cycles between Logic 0 and Logic 1 at a rate of 50 MHz, the output signals from timer U3 will remain in constant logic states. In this circumstance, timer U3 acts as a resettable on-delay timer, such that its output states (at pins 13 and 9) will remain in their Logic 1 or Logic 0 states as long as the output state of U2 periodically increases to Logic 1. In this manner, a constant output voltage is achieved at voltage signals $v_8A$ and $v_4A$. If a train occupies block 12, voltage signal $v_8A$ will remain at Logic 1 and voltage signal $v_5A$ will remain at Logic 0, thereby allowing current to flow through resistor R12. It will be understood that resistor R12 can represent any type of electrical load that will assist the railroad dispatcher in determining the operation of the railroad system. Examples of such loads could be relay coils, motor contactor coils, or other types of signalling or control equipment.

Train detection system 10 also has the optional capability of determining which direction a train is moving within block 12. In the case of both full scale and model railroads, pulse generator 44 is preferably used to provide bursts of 50 MHz square wave pulses according to a periodic schedule. A computer 42 is preferably used to control the precise timing as to when the bursts of pulses occur. Pulse generator 44 is provided to inject these bursts of 50 MHz square wave pulses at voltage signal $v_1$. Pulse generator 44 is preferably is a plug-in module for computer 42, or a serial port that is built into computer 42. In either circumstance, computer 42 will control the actual type of signal being generated by pulse generator 44 and the precise moments when those signals would be turned on or off. In the illustrated embodiment, it is preferred that voltage signal $v_1$ be at zero volts during those periods when the bursts of pulses are turned "off".

At the beginning of a burst of pulses $v_1$, such pulses are carried to north rail 14 by current $I_1$, then travel along north rail 14 via current $I_2$. If no train occupies block 12, the pulses will continue through resistance bond 30 via current $I_3$ to south rail 16, along south rail 16 via $I_4$, and finally to the east point 20 and into train detection circuit 50 via current $I_5$, creating a voltage $v_2$. Since resistance bond 30 is preferably 1.0 MΩ, most of the voltage generated at voltage signal $v_1$ will be dissipated by that resistance bond. The voltage signal $v_2$ will, therefore, have very little magnitude. When a train enters block 12, its wheels and axles 34 will create a low resistance path so that current can flow from north rail 14 to south rail 16 through the lower resistance path, creating a current $I_w$. The voltage drops across the wheels and axles will be greatly reduced as compared to the voltage drop across resistance bond 30. Under these circumstances, the magnitude of the voltage pulses at the input into detection circuit 50 will be greatly increased. As discussed above, for a full scale train, a typical resistance value for one axle and wheel set 34 will be 0.06Ω. For a model train having an electric motor in its model train engine, a typical resistance value through an axle, wheel, and motor will be about 20Ω. In both cases, the current $I_w$ flowing through the wheels and axles of either type of railroad engine is dissipates much less voltage than what otherwise have been dissipated by resistance bond 30.

A sensitivity adjustment can optionally be provided at the positive input of voltage comparator U2 to correct for varying weather conditions on a full scale railroad. If, for example, the weather is of high humidity, rain, snow or ice, it is preferred that the sensitivity of the input to voltage comparator U2 be lowered. This is because there will be more leakage current from the north rail 14 to south rail 16 through such weather conditions, which will tend to increase the amount of current $I_5$ being received by first stage 52 of train detection circuit 50. A preferred circuit would include a fixed resistor R14, having a value of 10 KΩ, connected in series to a variable resistor R15 of 10 KΩ. Using this circuit, the input impedance between voltage comparator U2 and DC common can be varied between 10 KΩ and 20 KΩ.

Figure 3:
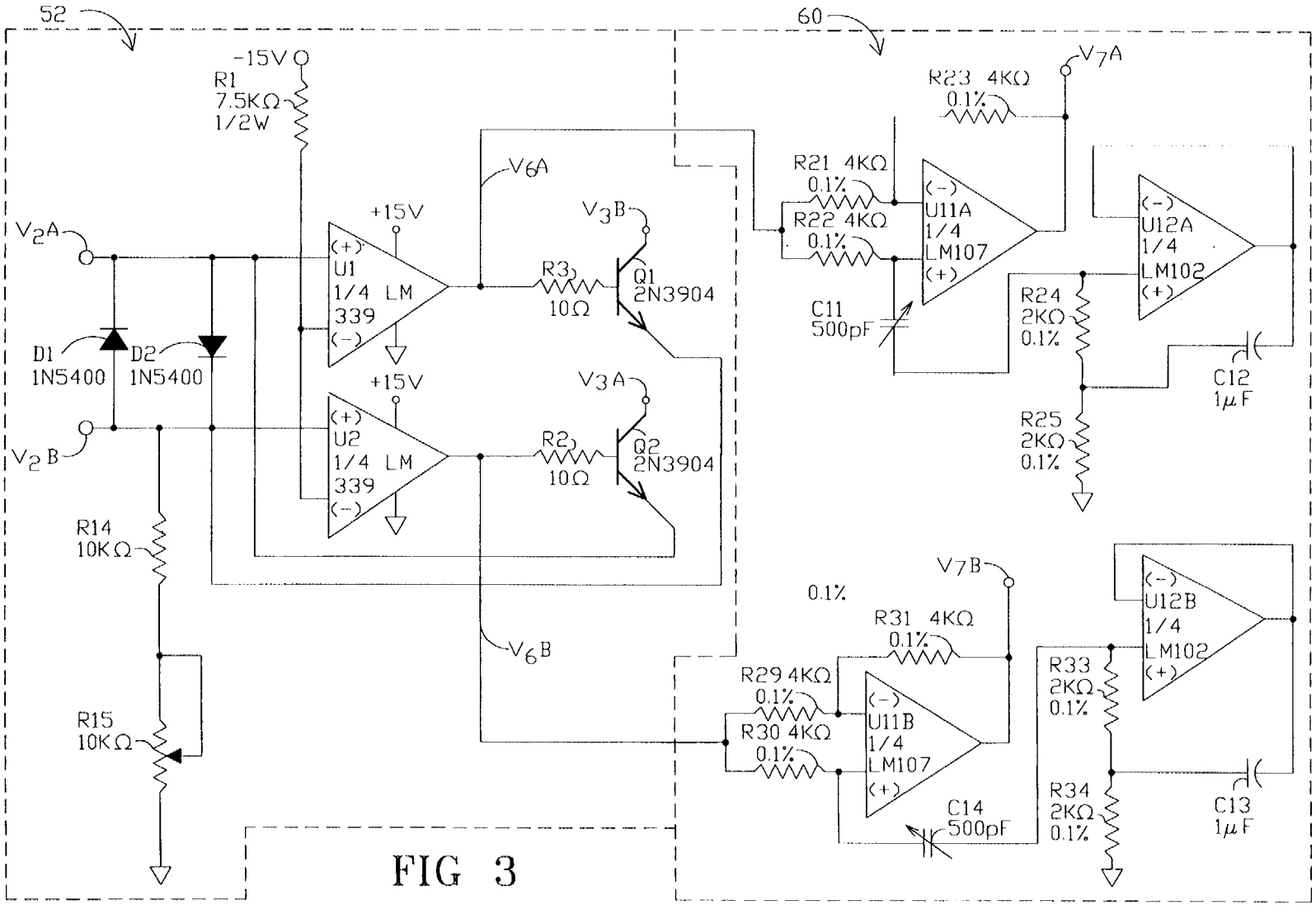
FIG. 3 is a schematic diagram of the high-pass filter circuit used in the train detection system of FIG. 1.

FIG. 3 depicts first stage detector 52 of train detection circuit 50 for use in detecting the direction of a train within block 12 using the pulses output by pulse generator 44. If no pulses are being generated by pulse generator 44, the input signal $v_2A$ will remain at or near zero volts, and the output state of voltage comparator U2 will remain at Logic 0. During this time, no current is being driven through resistor R4 into the base of transistor Q2, so transistor Q2 remains off and its collector will remain pulled up to the positive supply rail (not shown in FIG. 3). Voltage signal $v_3A$ will be in its Logic 1 state at a positive voltage. It will be understood that voltage signal $v_3A$, on FIG. 3, continues on to a second stage 54 and third stage 56 that are not shown on FIG. 3, but are depicted in FIG. 2. The second and third stages have been left off of FIG. 3 for the purposes of more clearly describing the operation of a high-pass filter circuit 60, described below.

It will be understood that diode D1, voltage comparator U1, resistor R3, and transistor Q1 are not directly involved in train detection circuit 50 when used with a full scale railroad, or in a model railroad layout circuit using Command Control. These components, however, would be used in a model train circuit using a dual-polarity DC power supply.

When a burst of pulses arrives at first stage 52 as a voltage signal $v_2A$, a voltage is created at the positive input of voltage comparator U2 that would be sufficient in magnitude to drive its output to a Logic 1 state. When this occurs, a current is provided through resistor R4 and into the base of transistor Q2, thereby placing transistor Q2 into saturation such that its collector voltage $v_3A$ is clamped to a near zero voltage magnitude. When that occurs, the second and third stages 54 and 56 of train detection circuit 50 operate in the same manner as described above.

In addition, the output of voltage comparator U2, designated by the voltage signal $v_6B$, is directed into the input of an operational amplifier U11B through resistors R29 and R30. Operational amplifiers U11B and U12B are two stages of a high-pass filter generally designated by the index numeral 60. The configuration and values of the resistors R29, R30, R31, R33, and R34 and capacitors C13 and C14 of this portion of high-pass filter 60 are configured to allow higher frequencies, such as 50 MHz, to pass to the output of operational amplifier U11B without being attenuated and become a voltage signal $v_7B$. Lower frequencies, including DC and frequencies in the range of 100 KHz to 200 KHz typically output from pulsed power packs used with model railroads will be attenuated to a point that they essentially are not passed via voltage signal $v_7B$. Therefore, voltage signal $v_7B$ will consist of a relatively clean 50 MHz pulse train during the time periods that a burst of such 50 MHz pulses is being received at first stage detector 52, even if other voltages are present in track detection system 10. Voltage signal $v_7B$ is then directed into propagation time analyzer circuit 62, to determine from which direction the train has entered block 12. It will be understood that high-pass filter 60 may not be needed on a full-scale railroad, depending upon whether or not addition data signals are to be passed through rails 14 and 16.

In situations where a model train layout is using Command Control, it may be desirous to use a power pack 38 that produces a positive voltage on the south rail 16 as compared to having a positive voltage on north rail 14. In such a circumstance, the power pack's current would flow through diode D1 of first stage detector 52 and into the positive input of voltage comparator U1. This would activate the other half of the circuit of first stage detector 52 and high-pass filter 60 in a similar manner to that described above. In this situation, it is preferred that the signal bursts admitted by pulse generator 44 have negative polarity at voltage signal $v_1$, such that these bursts of 50 MHz pulses would also flow through diode D1 and voltage comparator U1.

Under these circumstances, if a train occupies track 12, the voltage pulses at signal $v_2B$ will increase to a sufficient magnitude to toggle the output state of voltage comparator U1 between Logic 1 and Logic 0 as each of the 50 MHz pulses is received. When that happens, the output state of transistor Q1 and its associated collector voltage signal $v_3B$ will also toggle between Logic 1 and 0, thereby driving the second and third stages 54 and 56 in a manner described above. In addition, the output voltage of comparator U1 is directed, via voltage signal $v_6A$, into the high-pass filter circuit comprising operational amplifiers U11A and U12A, along with resistors R21, R22, R23, R24, R25 and capacitors C11 and C12. This high-pass filter outputs a voltage signal $v_7A$ which is a 50 MHz pulse train during the reception of a pulse burst at first stage 52, since the lower frequencies have been attenuated in a similar fashion to those signals that were attenuated by the other high-pass filter driving output signal $v_7B$.

Figure 4:
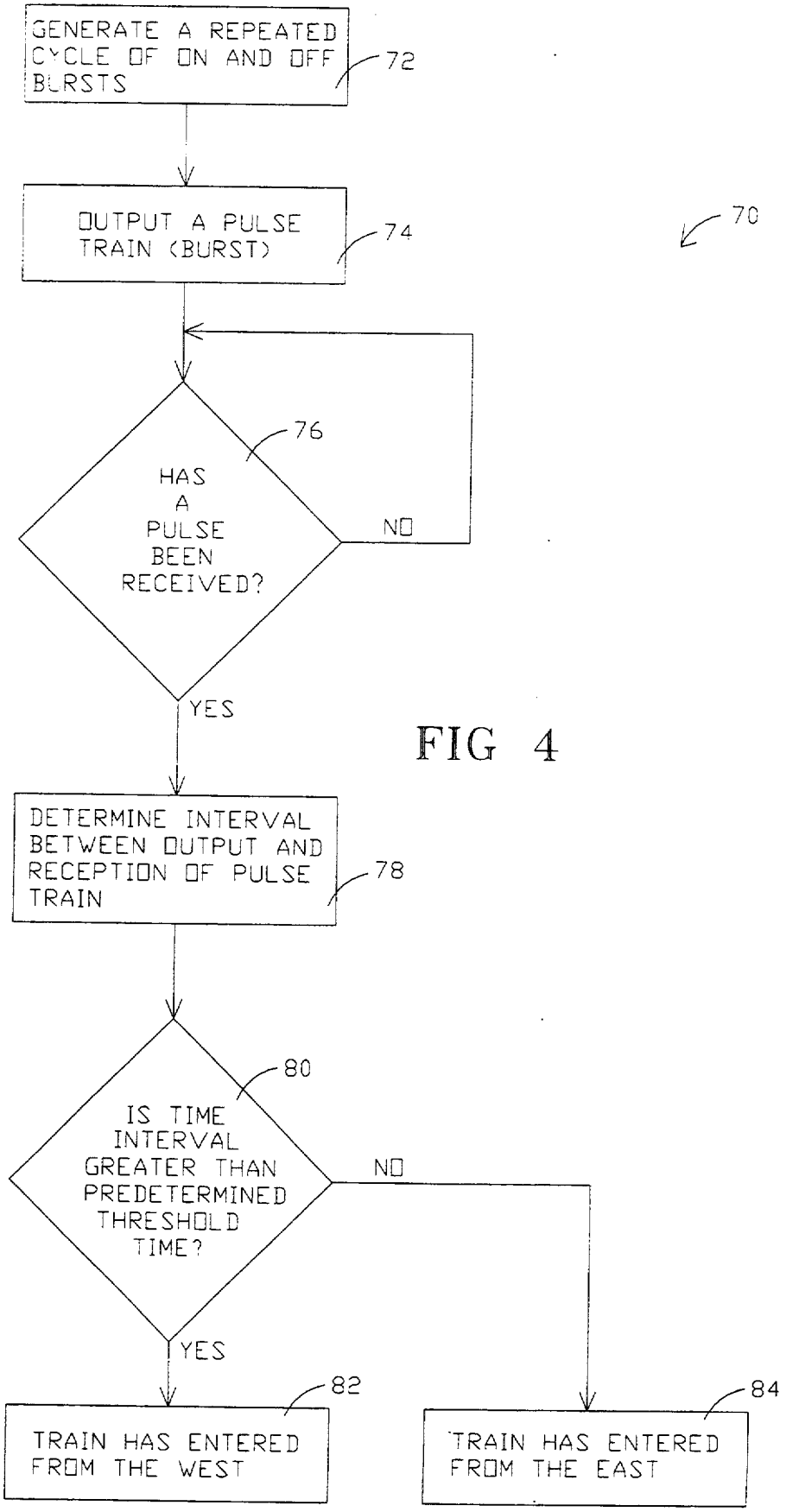
FIG. 4 is a flow-chart of a propagation time analyzer used in the train detection system of FIG. 1.

If a train occupies train block 12, and pulse generator 44 is presently outputting a burst of positive magnitude square waves at voltage signal $v_1$, then voltage signal $v_7B$ will also be a similar pulse train of 50 MHz square waves. Voltage signal $v_7B$ is input to a propagation time analyzer circuit 62, which preferably is a computer. A flow chart 70 describing the operation of this propagation time analyzer 62 is provided in FIG. 4, in which the computer controls both the timing of the initiation of each burst of pulses output from pulse generator 44, and the detecting of those pulses. It will be understood that the bursts comprising pulse trains of square waves can be of other types of waveforms than a square wave.

The first step in flow chart 70 is for the computer to generate a repeated cycle of on and off bursts of pulse trains, under the control of a function block designated by the index numeral 72. It is preferred that the beginning of each burst occur 100 times per second, and that the Off time of each one-hundredth second burst period be at least ten microseconds (10 μsec). This off time is important so that the pulse trains have a chance to propagate to and from the east and west ends of block 12 before beginning the initial period of the next burst of pulses.

After the computer have determined that a burst should now be initiated, it will command an output device, such as a serial port, to output a pulse train, using function block 74. As discussed above, the "On" duration of a particular burst pulse train will be determined by function block 72, as well as the "Off" time between the end of a particular burst and the beginning of the next particular burst. Once the pulse train has been output according to function block 74, the computer then determines whether a pulse train is presently being received or not, according to decision block 76. If a pulse train is not being received, decision block 76 continues to wait for a pulse train to be received before continuing to the next function block.

Once decision block 76 determines that a pulse train is being received, the computer determines the time interval between the initiation of the pulse train output according to function block 74 and a reception of a similar pulse train according to decision block 76, by function block 78. Function block 78 can be achieved by several different methods, one of which is to start a counter within the computer that increments every given number of nanoseconds and stopping that counter once decision block 76 senses that a pulse is presently being received. Once the time interval has been determined, it is compared, via decision block 80, to a predetermined threshold time to see if the actual time interval was greater than the predetermined threshold time. If the answer to this question is "No," than it has been determined that the train has entered block 12 from the east according to function block 84. If the answer to decision block 80 is "Yes," then it has been determined that a train has entered block 12 from the west according to function block 82.

It will be understood that the detection of the arrival of the pulses of a particular burst can be achieved in several different ways without departing from the principles of the present invention. For example, a computer is not necessary to determine whether the initial portion of a burst of pulses is being received, nor is a computer necessary to measure the time delay between the transmission of a burst and the reception of said burst. These functions can be performed by chip-level digital and analog integrated circuits.

The predetermined threshold time can be easily altered depending upon the actual conditions of a particular block along a railroad track. If a typical block is one (1) mile in length, it will take approximately five microseconds (5 μsec) for the pulse signal to travel from one end of the block to the other. Another five microseconds (5 μsec) would expire before that signal would be returned to the first end of that block. The predetermined threshold time could then be any time period less than ten microseconds (10 μsec), but preferably would be around two microseconds (2 μsec) to provide some tolerance for weather and other conditions at the actual railroad track.

By using a 2 μsec threshold time, it can be easily determined when if a train has entered from the east side of block 12, for the train's wheels and axles will shunt the voltage pulses output from pulse generator 44 from north rail 14 to south rail 16 very quickly (without significant time delay due to propagation of the signal between pulse generator 44 and first stage detector 52). On the other hand, if a train entered from the west side of block 12, the decrease in propagation time, as compared to having no train at all in block 12, would change very little until the eastbound train entering at the west side of block 12 came much closer to pulse generator 44 and first stage detector 52. It will be understood that different lengths of blocks would require corresponding different predetermined threshold times for use in determining train direction.

It will be understood that, using the detection scheme of the above illustrated embodiment, half-blocks are not required for determining train direction in a full scale railroad block. Therefore, the presently used set of batteries and relays used in each half-block of full scale railroads can be replaced with train detection system 10, without loss of any capability, including failsafe operation.

If it is desired to know the distance between the nearest portion of a train to the end of a particular block, the time delay between the transmission of voltage signal $v_1$ from pulse generator 44 and the reception of voltage signal $v_2$ at first stage detector 52 can be used to determine that distance. Since the propagation delay is due to the time for the signals to travel along the north and south rails 14 and 16, respectively (and through the nearest wheels and axle set of the train, which requires a very minimal propagation time), the distance of interest is one-half the propagation time divided by the speed of light. Of course, this arrangement will only properly measure the distance to the leading edge of an eastbound train or to the trailing edge of a westbound train, if pulse generator 44 and first stage detector 52 are on the east side of block 12.

To measure the distance from the west edge of block 12 to a train, a second pulse generator (not shown), preferably transmitting a different pulse frequency than that of pulse generator 44, would be located to inject its pulse output signal at the west point 22 of north rail 14, and a second first stage detector (not shown) would be located to receive such pulse frequency at the west point 24 of south rail 16. This second set of pulse transmitting and receiving equipment would be able to detect the distance to the leading edge of a westbound train or to the trailing edge of an eastbound train.

Another method to make train detection system 10 failsafe is to provide a secondary broken rail detector 66 that senses the propagation delay between the initial portion of a burst leaving pulse generator 44 and the initial reception of that burst as it is received at broken rail detector 66. Broken rail detector 66 is very similar to propagation time analyzer 62, and its functions can be executed by the same computer, using a similar flow chart to that of FIG. 4. Broken rail detector 66 uses a predetermined threshold time which is greater than the expected total system propagation time when no train occupies block 12.

If rails 14 and 16 are intact, then the actual propagation time before voltage signal $v_2$ is received at broken rail detector 66 will always be less than the predetermined threshold time (whether a train is present or not in block 12). On the other hand, if either rail 14 or 16 breaks, then the actual propagation time will become indefinite, thereby exceeding the predetermined threshold time, and an alarm signal would be sent to the train dispatcher. For example, if block 12 is one mile in length, then the expected total system propagation time is 10.8 μsec, and the predetermined threshold time could be set to 11.0 μsec, or to a greater time interval to allow for a system having greater tolerance. It will be understood that the predetermined threshold time must be set to a time interval of substantially less than the time period between the initiation of one pulse burst to the next.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A train detection circuit for use with railroad traffic on a railroad track having a first end and a second end, said circuit comprising:

(a) an electrical signal generator which outputs a first pulse signal;

(b) a first rail of a railroad track, said first rail being electrically conductive, said first rail being electrically connected to the output of said electrical signal generator;

(c) a second rail of a railroad track, said second rail being electrically connected to said first rail via a resistance bond, said second rail conducting at least a portion of said first pulse signal at all times whether railroad traffic occupies said railroad track or not, thereby creating a second pulse signal; and (d) a pulse detection circuit electrically connected to said second rail, said pulse detection circuit receiving said second pulse signal, said pulse detection circuit having an output which changes state between a first condition and a second condition depending upon the magnitude of said second pulse signal as compared to a predetermined magnitude, said output state being indicative of whether a train occupies said railroad track or not.

2. The train detection circuit as recited in claim 1, wherein said railroad traffic comprises at least one electrically powered model railroad engine.

3. The train detection circuit as recited in claim 1, wherein said railroad traffic comprises a full scale railroad wheels and axle set.

4. A train detection circuit as recited in claim 1, wherein the output of said pulse detection circuit is electrically connected to a remote computer to monitor railroad traffic.

5. A train detection circuit for use with railroad traffic on a railroad track having a first end and a second end, said circuit comprising:

(a) an electrical signal generator which outputs a first pulse signal;

(b) a first rail of a railroad track, said first rail being electrically conductive, said first rail being electrically connected to the output of said electrical signal generator;

(c) a second rail of a railroad track, said second rail being electrically connected to said first rail via a resistance bond, said second rail conducting at least a portion of said first pulse signal at all times whether railroad traffic occupies said railroad track or not, thereby creating a second pulse signal; and (d) a pulse detection circuit receiving said second pulse signal, said pulse detection circuit having an output which changes state between a first condition and a second condition depending upon the magnitude of said second pulse signal as compared to a predetermined magnitude, said output state being indicative of whether a train occupies said railroad track or not;

(e) a propagation time analyzer, comprising:

(i) a timing controller circuit configured to control the timing of said electrical signal generator such that said first pulse signal is periodically turned off, then on as a burst of electrical pulses;

(ii) a time interval detection circuit configured to determine a time interval between the initial reception of said second pulse signal, as a burst of electrical pulses, and the initial transmission of said first pulse signal, as a burst of electrical pulses; and (iii) a time comparator circuit configured to compare said time interval to a predetermined time period, the result of said comparison being indicative of which end of said railroad track said train entered from.

6. A train detection circuit as recited in claim 5, wherein said time interval is used to determine the distance between the nearest portion of a full scale train and the first end of said railroad track.

7. A train detection circuit as recited in claim 5, wherein the output of said current detection circuit is electrically connected to a remote computer to monitor railroad traffic.

8. A train detection circuit as recited in claim 5, further comprising a high-pass filter which does not significantly attenuate said second pulse signal but does attenuate lower frequency electrical signals.

9. A train detection circuit as recited in claim 8, wherein said lower frequency electrical signals include voltage and current signals supplied by model railroad power packs.

10. A train detection circuit as recited in claim 1, further comprising a propagation time analyzer which includes:

(a) a timing controller circuit configured to control the timing of said electrical signal generator such that said first pulse signal is periodically turned off, then on as a burst of electrical pulses;

(b) a time interval detection circuit configured to determine a time interval between the initial reception of said second pulse signal, as a burst of electrical pulses, and the initial transmission of said first pulse signal, as a burst of electrical pulses; and (c) a time comparator circuit configured to compare said time interval to a predetermined time period, the result of said comparison being indicative of whether or not said first rail or said second rail has broken.

11. A train detection circuit as recited in claim 10, wherein said propagation time analyzer comprises a computer which includes all hardware and software required to perform the tasks of said timing controller circuit, said time interval detection circuit, and said time comparator circuit.

12. A train detection circuit as recited in claim 5, wherein said propagation time analyzer comprises a computer which includes all hardware and software required to perform the tasks of said timing controller circuit, said time interval detection circuit, and said time comparator circuit.

13. A model train-detection circuit for use with model railroad engines that are powered by electricity from a railroad track having at least two rails, said circuit comprising:

(a) an electrical power supply which outputs a first bias current;

(b) a first rail of a railroad track, said first rail being electrically conductive, said first rail being electrically connected to the output of said electrical power supply;

(c) a second rail of a railroad track, said second rail conducting at least a portion of said first bias current through a model railroad engine at times when a model railroad engine occupies said railroad track, thereby creating a second bias current; and (d) a current detection circuit electrically connected to said second rail, said current detection circuit comprising a switching circuit receiving said second bias current, said switching having an output which changes state between a first condition when said second bias current is greater than a predetermined magnitude and a second condition when said second bias current is less than said predetermined magnitude, said output state being indicative of whether a train occupies said railroad track or not.

14. The model train detection circuit as recited in claim 13, wherein the output of said current detection circuit indicates whether a non-moving model railroad engine occupies said railroad track or not.

15. The model train detection circuit as recited in claim 13, wherein the output of said current detection circuit is electrically connected to a remote computer to monitor railroad traffic.

* * * * *